US006603430B1

(12) United States Patent
Hill et al.

(10) Patent No.: US 6,603,430 B1
(45) Date of Patent: Aug. 5, 2003

(54) HANDHELD WIRELESS COMMUNICATION DEVICES WITH ANTENNA HAVING PARASITIC ELEMENT

(75) Inventors: Robert Hill, Salinas, CA (US); Juan Zavala, Watsonville, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/802,805

(22) Filed: Mar. 9, 2001

Related U.S. Application Data

(60) Provisional application No. 60/188,608, filed on Mar. 9, 2000.

(51) Int. Cl.[7] ..... H01Q 1/38

(52) U.S. Cl. ..... 343/702; 343/795; 343/803; 343/833

(58) Field of Search ..... 343/702, 700 MS, 343/793, 795, 833, 806, 895, 803

(56) References Cited

U.S. PATENT DOCUMENTS 5,999,140 A * 12/1999 Johnson ..... 343/702
6,147,653 A * 11/2000 Wallace et al. ..... 343/702
6,239,765 B1 * 5/2001 Johnson et al. ..... 343/702
6,392,599 B1 * 5/2002 Ganeshmoorthy et al. .. 343/700 MS
6,404,394 B1 * 6/2002 Hill ..... 343/700 MS

* cited by examiner

*Primary Examiner*—Don Wong
*Assistant Examiner*—Shih-Chao Chen
(74) *Attorney, Agent, or Firm*—Fulbright & Jaworski L.L.P.

(57) ABSTRACT

A simple internal or partly internal antenna system for optimizing the radiation pattern from hand held wireless communications devices HHWCD such as hand-held data devices and cellular telephones is disclosed. The antenna system consists of an essentially internal or partly internal asymmetrical dipole with quarter-wave resonator section and radiating planar section, in conjunction with a planar parasitic director element. The radiating planar section may be the ground traces of the HHWCDs printed wiring board PWB. The antenna system provides for single or multiple frequency band operation.

17 Claims, 10 Drawing Sheets

HANDHELD WIRELESS COMMUNICATION DEVICES WITH ANTENNA HAVING PARASITIC ELEMENT

CROSS-REFERENCE TO RELATED APPLICATIONS

This application claims priority of U.S. Provisional Patent Application S. No. 60/188,608, of Robert Hill and Juan Zavala, filed Mar. 9, 2000

FIELD OF THE INVENTION

The invention relates to hand-held wireless communication devices (HHWCDs), such as hand-held data devices, cellular telephones, and the like, having an antenna. In particular, the invention relates to such devices having an antenna system, the antenna system including a parasitic director element. The antenna system can be internal or partially internal to the device. The HHWCDs having antennas according to the present invention may be used for transmitting, receiving or for transmitting and receiving.

DESCRIPTION OF RELATED ART

Omnidirectional and near-omnidirectional antennas are used for HHWCDs, including both external and internal types. Examples of such antennas include the following;

- a half-wavelength straight wire, mounted externally; and
- an asymmetric dipole having a planar radiating half and a second half, wherein the second half includes one of the following:
  - a quarter-wavelength straight or coiled wire, mounted externally;
  - a quarter-wavelength planar line resonator, mounted internally; and
  - a planar inverted-F quarter-wavelength resonator.

Any of the just-described asymmetric dipoles may be employed as the driven element of the antenna system of the present invention.

All of the above antennas exhibit a primarily omnidirectional radiation pattern. Because HHWCDs in use are typically located near the user, a substantial portion of the energy radiating from the antenna is absorbed by the user's body when the above-listed antenna types are used.

SUMMARY OF THE INVENTION

A principal object of the invention is to control the antenna radiation pattern of a HHWCD antenna to minimize the energy absorbed by the user's body when the antenna is used for transmitting.

A related object of the invention is to control the antenna radiation pattern of a HHWCD antenna so as to minimize the energy absorbed by the user's body when the antenna is used for transmitting without increasing the size of the HHWCD.

A further object is to increase the energy available on transmit or receive in directions other than toward the user's body.

A related object is to increase the energy available on transmit or receive in directions other than toward the user's body without increasing the size of the HHWCD.

Another object, applicable only to some of the described embodiments, is to provide a simple low-cost internal antenna system for HHWCDs, suitable for high volume manufacturing and eliminating the susceptibility to damage of external antennas.

Another objective of the invention is to use the existing printed wiring board (PWB) or printed circuit board (PCB) of a HHWCD as part of an internal or partly internal antenna system.

Another objective of the invention is to provide a controlled pattern antenna system for single or multiple frequency bands.

According to the teachings of the present invention, HHWCDs have an antenna system comprising an asymmetrical dipole with a planar resonator element or section and a planar radiating element or section, in conjunction with a planar parasitic director element. The asymmetrical dipole constitutes the antenna system's driven element. The parasitic director element is positioned in the HHWCD generally opposite the HHWCD's PWB from the normal location of the user when using the HHWCD so that the resulting antenna pattern has its field generally maximized in the direction away from the user and generally minimized in the direction toward the user. The radiating planar section may be the ground traces of the HHWCD's printed wiring board (PWB). The resonator element may be planar and configured as a meandering or serpentine conductor in order to save space and allow the antenna to be totally internal within the device. Alternatively, the resonator need not be planar and need not be internal. The resonator may be, for example, an essentially quarter-wavelength straight or coiled wire, mounted externally or an essentially quarter-wavelength planar inverted-F. The resonator has negligible radiation because of its configuration. In the case of an internal planar meandering or serpentine conductor, the resonator's conductor may be the conductive printed wiring trace on a PWB dielectric, a metal stamping, or the like. In alternative embodiments of the antenna system, the resonator element may be modified to provide multiple-frequency-band operation and the parasitic director element may be modified to provide multiple-frequency-band operation.

DESCRIPTION OF THE PREFERRED EMBODIMENTS

Figure 1A:
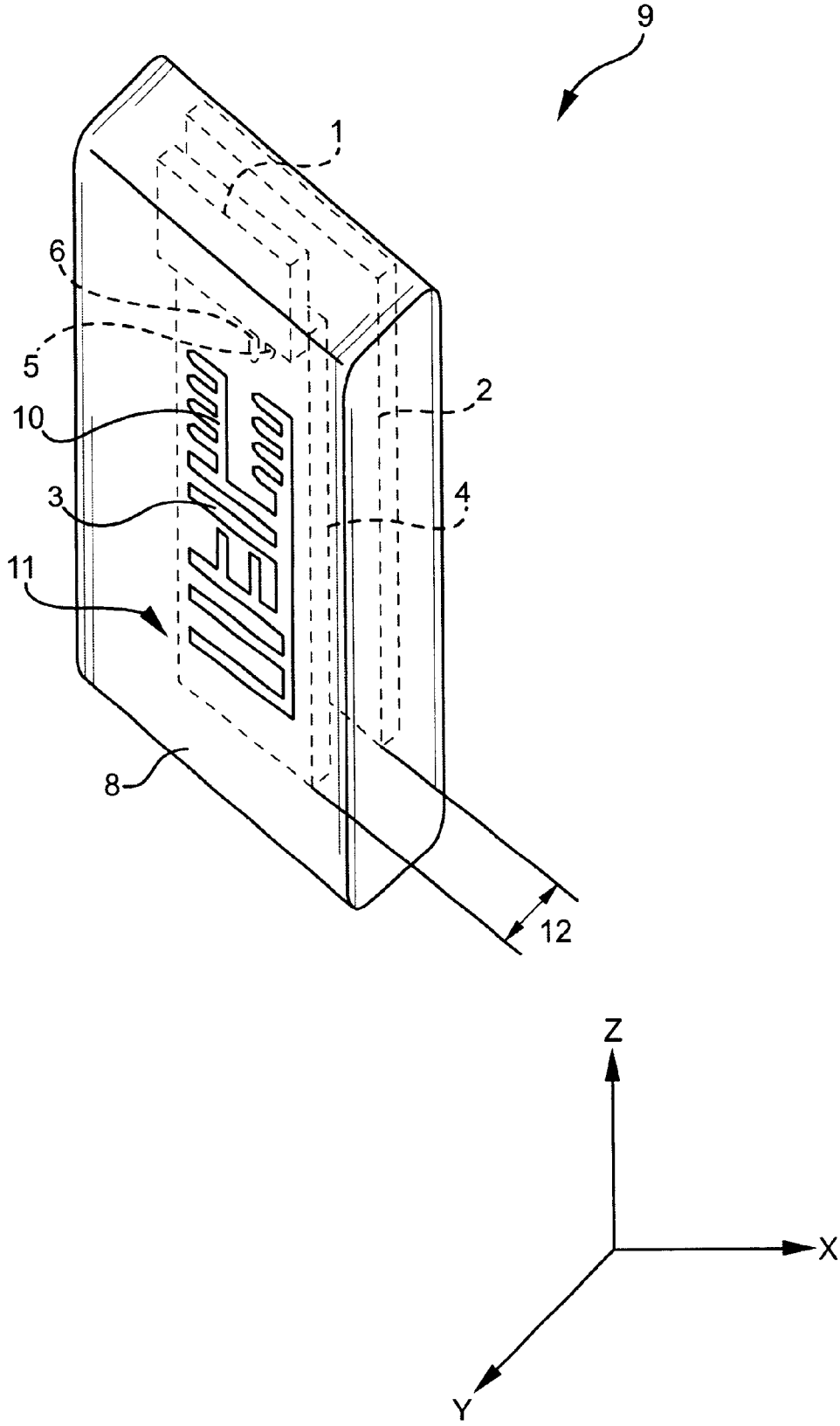
FIG. 1A is an idealized perspective view of one embodiment of the antenna system according to the present invention, located within or nearly within a HHWCD case. The figure is not to scale.

Referring to FIG. 1A, a HHWCD 9 is shown with an essentially internal antenna system according to the present invention. The antenna system includes a planar resonator 1, a planar radiating conductor 3 attached to a dielectric substrate 4, and a planar parasitic director element 2. A plastic case contains the entire HHWCD, and, in operation, the user is located in direction 10 relative to a front panel 11. Parasitic director element 2 may be a thin metal layer such as a foil tape, a plating, or a deposited metal attached to the plastic housing 8. Inasmuch as the foil tape, plating or metal deposit can be on an external surface of the HHWCD, this embodiment is referred to as "essentially internal."

Element 1 may be surface mounted to element 3 resulting in a slight offset of the planar resonator element 1 with respect to the planar radiating element 3. Element 2 has dimensions that cause it to act as a parasitic director when located close to the resonator 1 and radiating conductor 3, the overall combination of elements 1, 2 and 3 acting as a two-element directional antenna array. In order to function as a director, a major dimension of element 2 should be somewhat less than an electrical half wavelength in the frequency band of interest. The parasitic director element 2 need not be electrically connected to anything in the HHWCD; however, a low impedance region (near its electrical center) may be connected, for example, to ground in the HHWCD.

In the embodiment of FIG. 1A, elements 1 and 3 lie in generally parallel planes, although they may be coplanar if they are held with respect to each other by a form of attachment other than surface mounting (alternatives include, for example, tabs extending from one board extending into receptacles in the other or pins interconnecting the boards). The particular mode of attachment is not critical to the invention. Moreover, elements 1 and 3 need not be coplanar with respect to each other—they may be perpendicular with respect to each other as described below in connection with the alternative embodiment of FIG. 4 or they may be at an angle with respect to each other, such as, for example 45 degrees, provided, however, that element 1 is not folded back and downward toward element 3 so that it tends to lie over element 3. When element 1 is mechanically connected to element 3 by surface mounting, it may be electrically connected to element 3 by reflow soldering.

The resonator element 1 is electrically connected to the planar radiating conducting element 3 at point 5. Element 1 has an electrical length of about a quarter wavelength within the desired frequency band of operation. The resonator element is shunt fed by feeding the element between point 6 and a nearby point on element 3. A matching section is located in element 1 between points 5 and 6, providing a nominally 50 ohm feed point at point 6 with respect to a nearby point on element 3. A coaxial feedline or microwave stripline may be used to connect to the 50 ohm feed points (the nearby point on element 3 providing the ground connection) to the receive, transmit, or receive/transmit circuitry (not shown) of the HHWCD.

The resonator element 1 and the radiating conducting element 3 form an asymmetrical dipole with linear polarization along the z-axis. The plane of the parasitic director element 2 is spaced from the plane of element 1 and the plane of element 3 (if different from the plane of element 1) in the range 0.05–0.2 wavelength by distance 12. The dimensions of element 2 are adjusted in practice to optimize desired directivity and impedance match. Radiating conducting element 3 may be formed by the ground traces of the HHWCD's PWB. Element 3 is shown in FIG. 2E as a continuous conductor for simplicity. The radiating conducting element 3 has at least one dimension greater than about one-quarter wavelength electrically within the desired frequency band of operation.

Figure 1B:
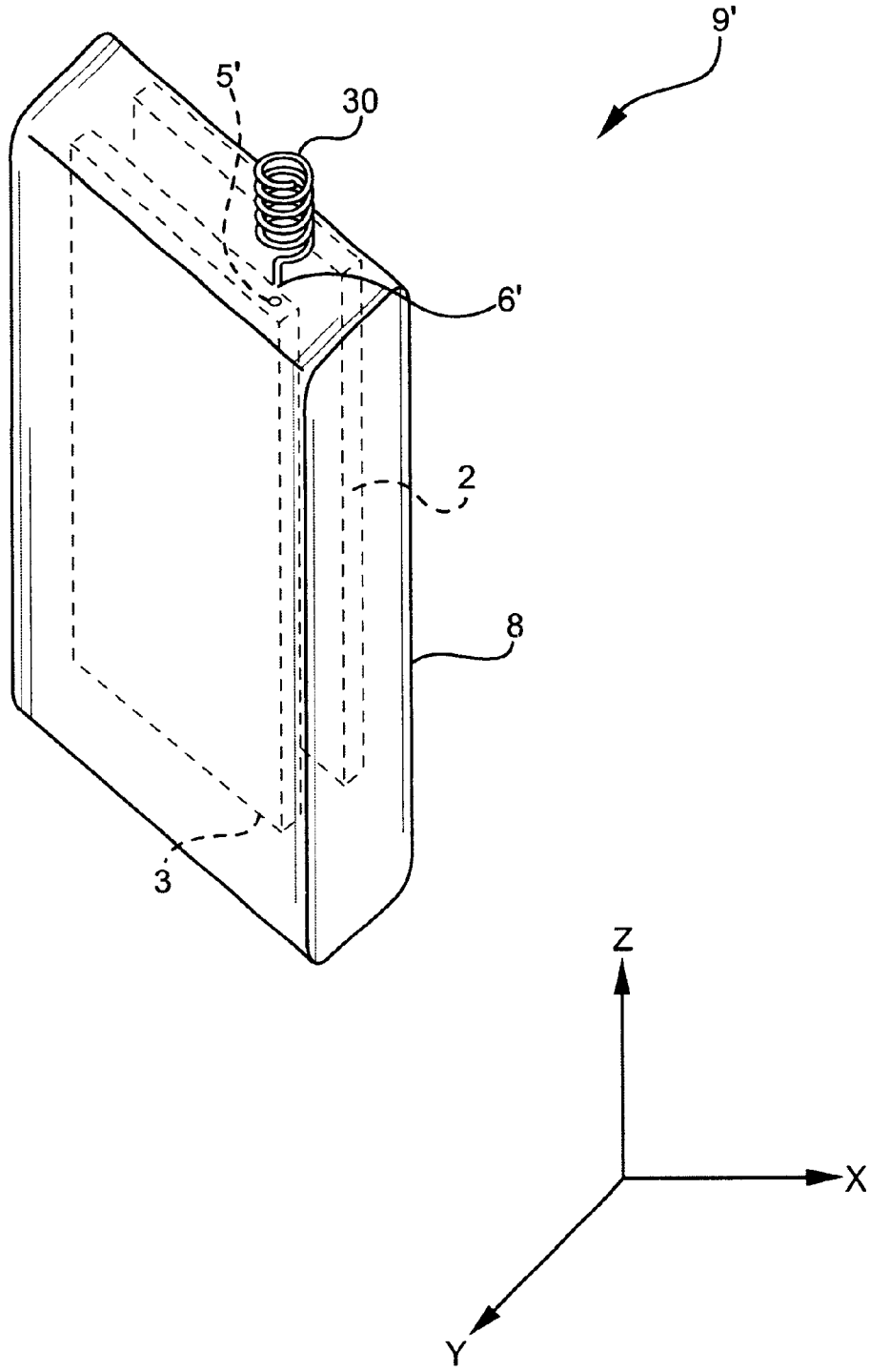
FIG. 1B is an idealized perspective view of an alternative embodiment of the antenna system according to the present invention, partly located within a HHWCD case in which the resonator is externally mounted on the HHWCD. The figure is not to scale.

As mentioned above, the resonator portion of the asymmetrical dipole may have configurations other than a planar meandering pattern as in FIG. 1A. One such alternative is shown in FIG. 1B that shows a perspective view of an HHWCD 9'. In this embodiment, the resonator portion of the asymmetrical dipole is an external coiled quarter-wave conductor 30. Conductor 30 is spaced slightly from element 3 (the other half of the asymmetrical dipole) at point 5'. Conductor 30 can be directly fed across points 5' and 6'.

Figure 2A:
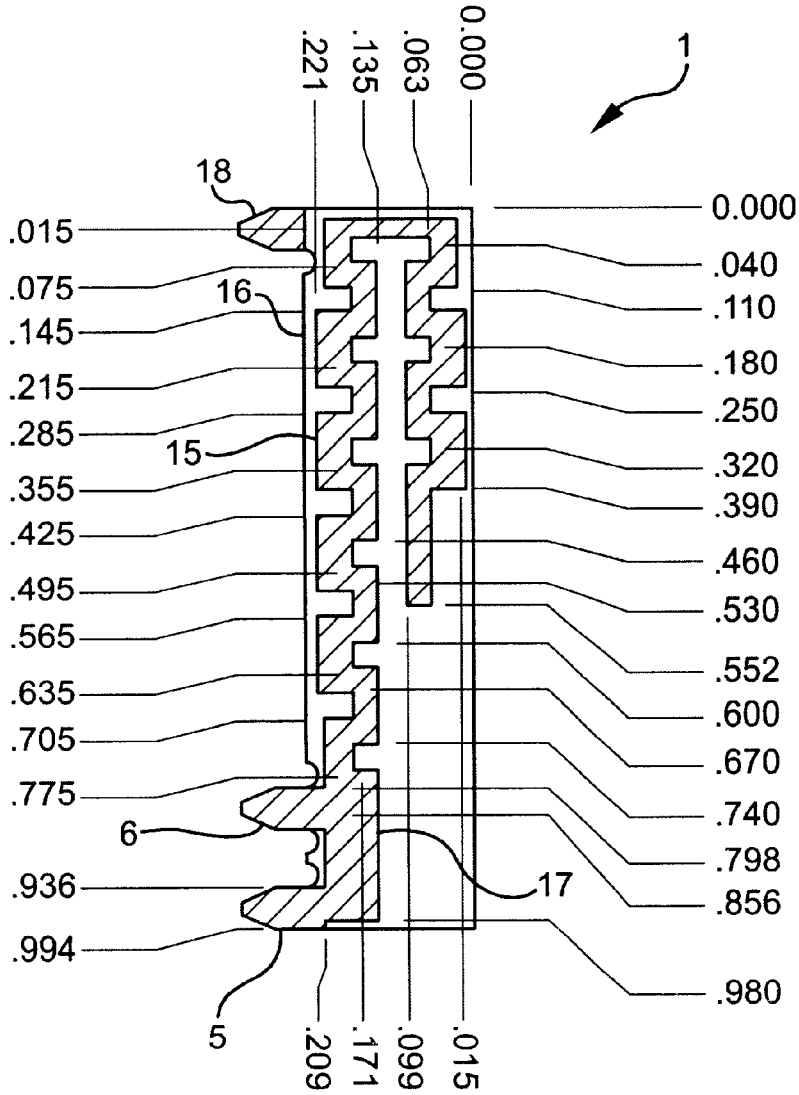
FIG. 2A is a plan view of the planar resonator element or section of the antenna of FIG. 1A, shown with dimensions in inches suitable for operation in the 1.75–1.87 GHz frequency band.
Figure 2B:
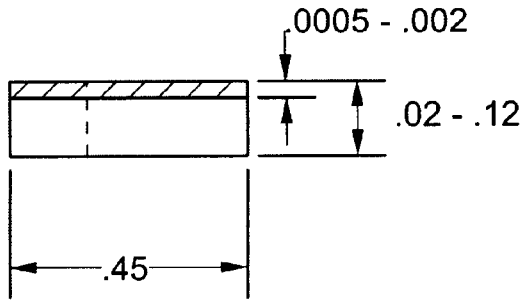
FIG. 2B is an end elevation view of the planar resonator element or section of the antenna of FIG. 2A, shown with dimensions for the thickness of the conductive trace and the dielectric of a suitable PWB.

Referring to FIGS. 2A and 2B, a resonator 1 suitable for use in the FIG. 1A embodiment is formed as a printed wiring board PWB, with conducting trace 15 on dielectric substrate 16. The conducting trace preferably has a meandering or serpentine shape, an example of which is shown in FIG. 2A. The dimensions shown are suitable for operation in the 1.75–1.87 GHz frequency band. These and all other dimensions shown in the various figures are in inches. It will be understood that the dimensions shown are not critical and that the antenna system and resonator 1 may be dimensioned for other microwave frequency ranges. Dielectric substrate 16 may be any common PWB material such as fiberglass. The conducting trace, shown as the shaded area, may be copper. Trace 17 is the matching line portion, referred to above. When the resonator element 1 is mounted on element 3, point 5 is electrically connected to the corresponding point on element 3. Point 6 provides a 50-ohm nominal feed point across to the corresponding nearby point on 3. The isolated trace section 18 is provided for mechanical mounting to 3 when surface mounting is employed.

Figure 2C:
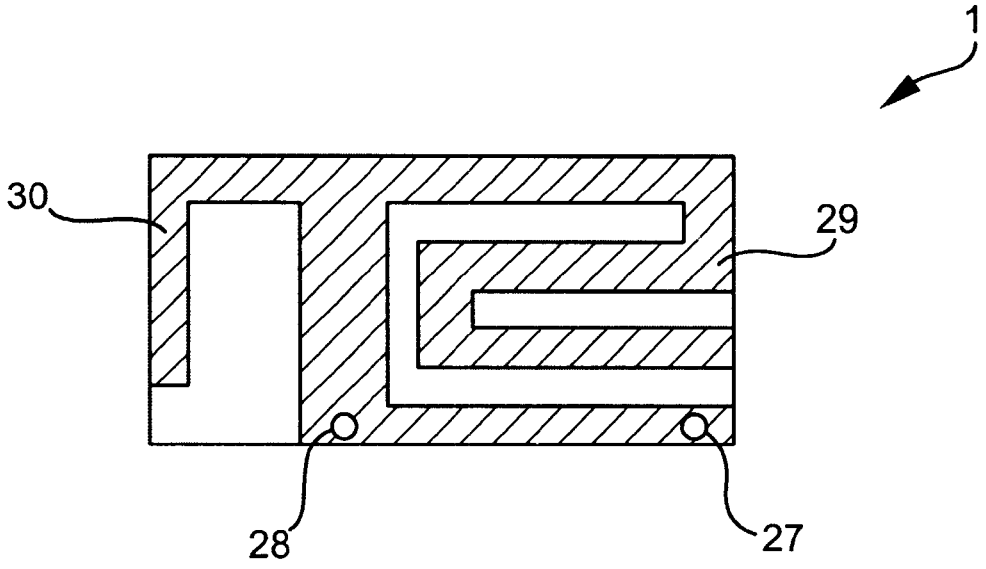
FIG. 2C is a plan view of an alternative dual-band embodiment of the planar resonator element or section of the antenna of FIG. 1A and FIG. 1B.
Figure 2D:
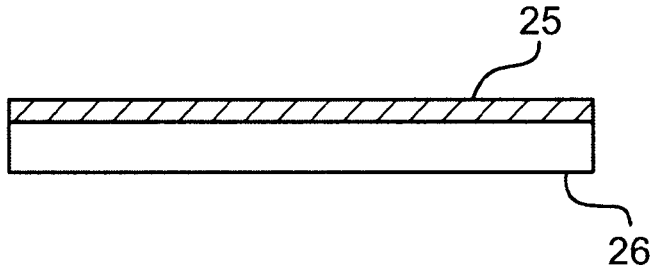
FIG. 2D is an end elevation view of the alternative dual-band embodiment of the planar resonator element or section of the antenna of FIG. 2C.
Figure 2E:
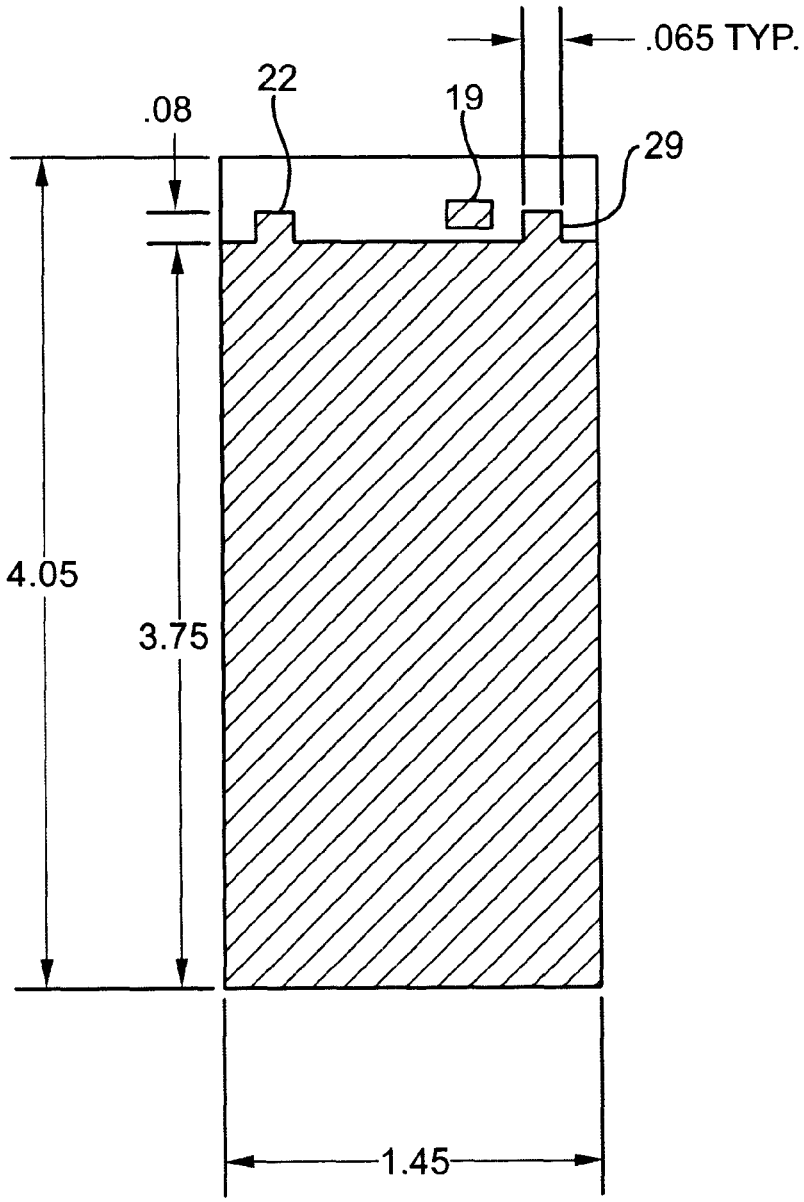
FIG. 2E is a plan view of the planar radiating section or element of the antenna of FIG. 1A and FIG. 1B, shown with dimensions for operation in the 1.75–1.87 GHz frequency band.

Dual band operation of the asymmetrical dipole may be provided by employing a modified resonator 1. An embodiment of a planar dual band resonator is shown in FIGS. 2C and 2D. Instead of having a single branch serpentine or meandering conductor, a conductor 25 with multiple branches or resonant portions 29 and 30 is provided. As in the single band embodiment of FIGS. 2A and 2B, the conductor 25 is attached to a dielectric 26. Conductor portion 29 generally resonates within a lower frequency band, while conductor portion 30 resonates within a higher frequency band. Location 27 connects to a corresponding location at one end of element 3, and location 28 provides one side of a 50 ohm feedpoint, the other side being a corresponding point on element 3, in the manner of the single band embodiment described above. Various ones of possible non-planar resonators may also be configured to operate in multiple frequency bands in accordance with principles well known in the antenna art.

Figure 2F:
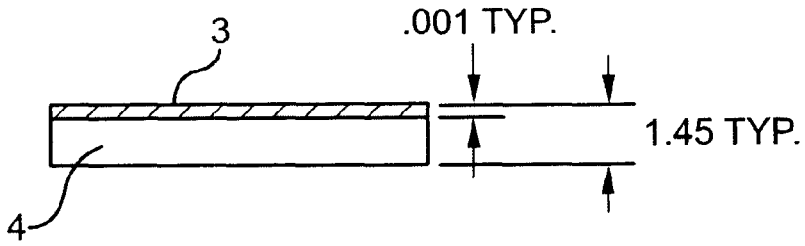
FIG. 2F is an end elevation view of the planar radiating element or section of the antenna of FIG. 2F, shown with dimensions for the thickness of the conductive trace and the dielectric of a suitable PWB.

Referring to FIGS. 2E and 2F, a radiating conductor element 3 is formed as a printed wiring board PWB, with conducting traces on a dielectric substrate. The radiating conducting element 3 may be formed by the ground traces of the HHWCD's PWB. Element 3 is shown in FIG. 2E as a continuous conductor for simplicity. The dimensions shown, which, in the case of the element being ground traces, are the outside dimensions of the PWB, are suitable for operation in the 1.75–1.87 GHz frequency band. It will be understood that the dimensions shown are not critical and that the antenna system and resonator 1 may be dimensioned for other microwave frequency ranges. Dielectric substrate 16 may be any common PWB material such as fiberglass. The conducting trace, shown as the shaded area, may be copper. Locations for electrically connecting element 1 to element 3 are indicated at point 20, where point 5 of element 1 connects, and at point 19, where point 6 of element 1 connects. A mechanical connection may be made at point 22, where point 18 from element 1 may be soldered.

Figure 2G:
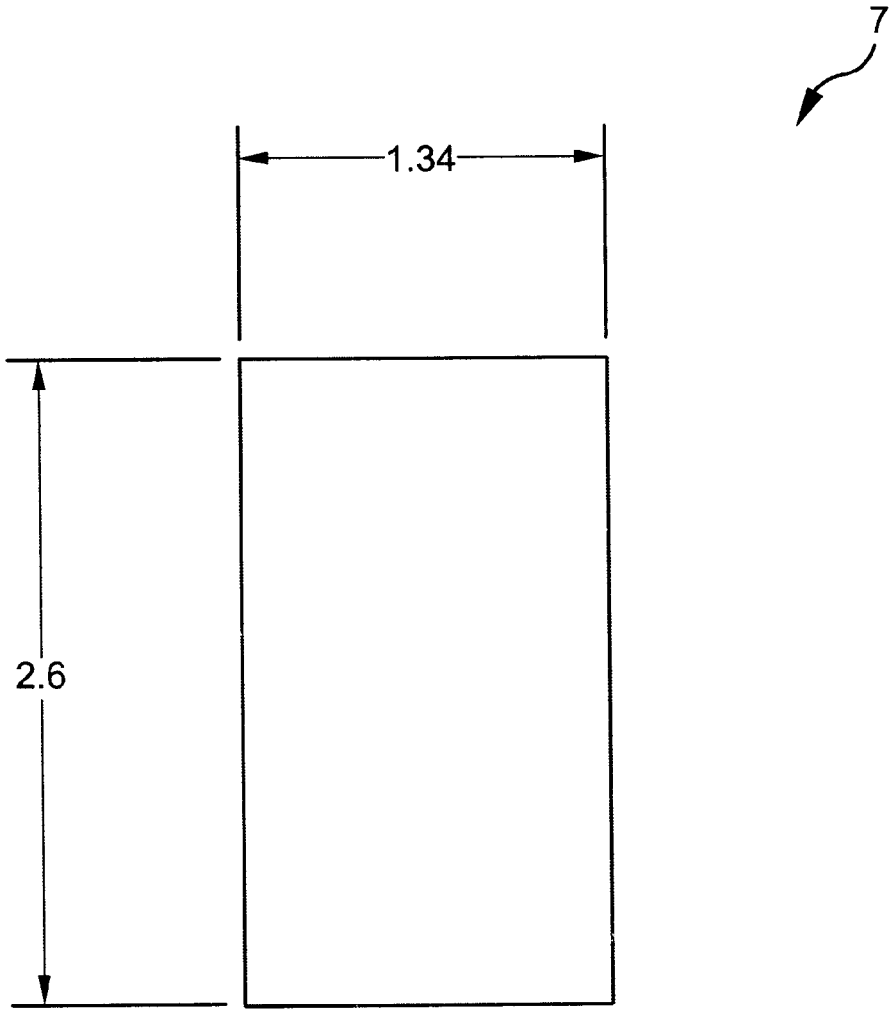
FIG. 2G is a plan view of the parasitic director element of the antenna of FIG. 1A and FIG. 1B shown with dimensions for operation in the 1.75–1.87 GHz frequency band.
Figure 2H:
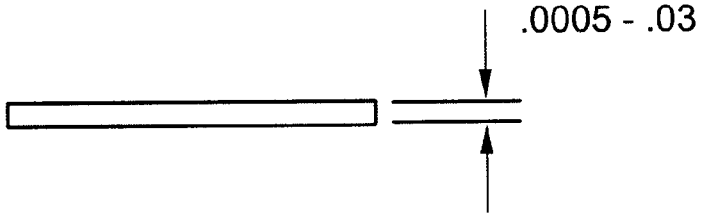
FIG. 2H is an end elevation view of the parasitic director element of FIG. 2G, shown with a suitable thickness dimension

Referring to FIGS. 2G and 2H, the parasitic director element 2 preferably is formed by a thin metal planar conductor which may be a foil tape, a plating, or a deposited metal attached to the interior or exterior of the plastic housing 8 (FIG. 1A and FIG. 1B) of the HHWCD. The dimensions shown are suitable for operation in the 1.75–1.87 GHz frequency band. It will be understood that the dimensions shown are not critical and that the antenna system and parasitic director 2 may be dimensioned for other microwave frequency ranges.

Figure 2I:
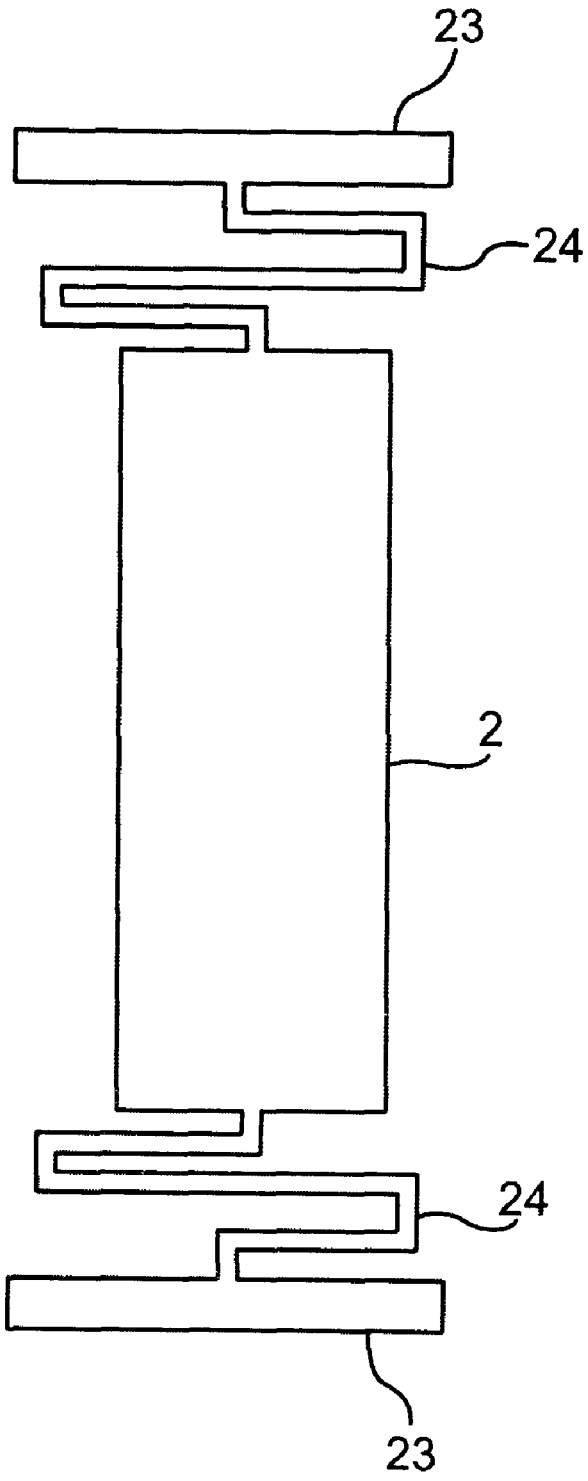
FIG. 2I is a partially schematic plan view of a dual-frequency-band embodiment of the parasitic director element of FIG. 1A and FIG. 1B.

Referring to FIG. 2I, dual band operation of the parasitic director element is possible by choosing the length of the element 2 to be somewhat less than an electrical half wavelength at a frequency f1 in a higher frequency band of interest. A meandering inductor 24 and top-loading capacity hats 23 at each end of element 2 establish a second electrical length somewhat less than a frequency f2 in a lower frequency band (the frequency f1 is higher than the frequency f2). Inductors 24 have sufficient reactance to act as a radio-frequency (RF) choke in the higher frequency band. Thus, dual band operation of the parasitic director is provided. Dual band operation of the driven element is described above. A dual band antenna system is thus provided by employing dual band driven and parasitic elements. Dielectric substrate 16 may be any common PWB material such as fiberglass. The central part of element 2, the meandering inductors and the top hats can be conductive traces on a printed circuit board.

Figure 3A:
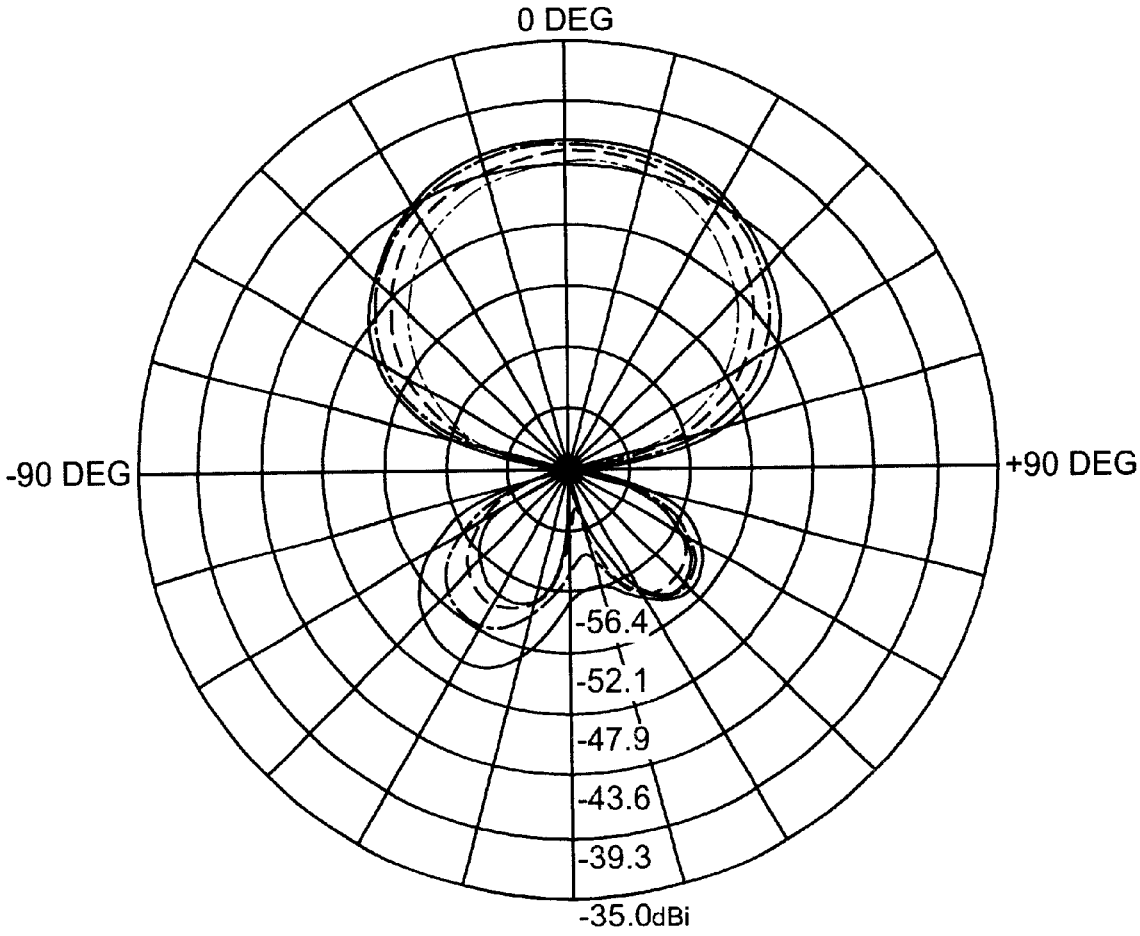
FIG. 3A is an exemplary polar plot of the radiation patterns for several frequencies in the 1.75–1.87 GHz frequency band, about the x-axis of a practical embodiment of the antenna system of FIG. 1A for particular dimensions.
Figure 3B:
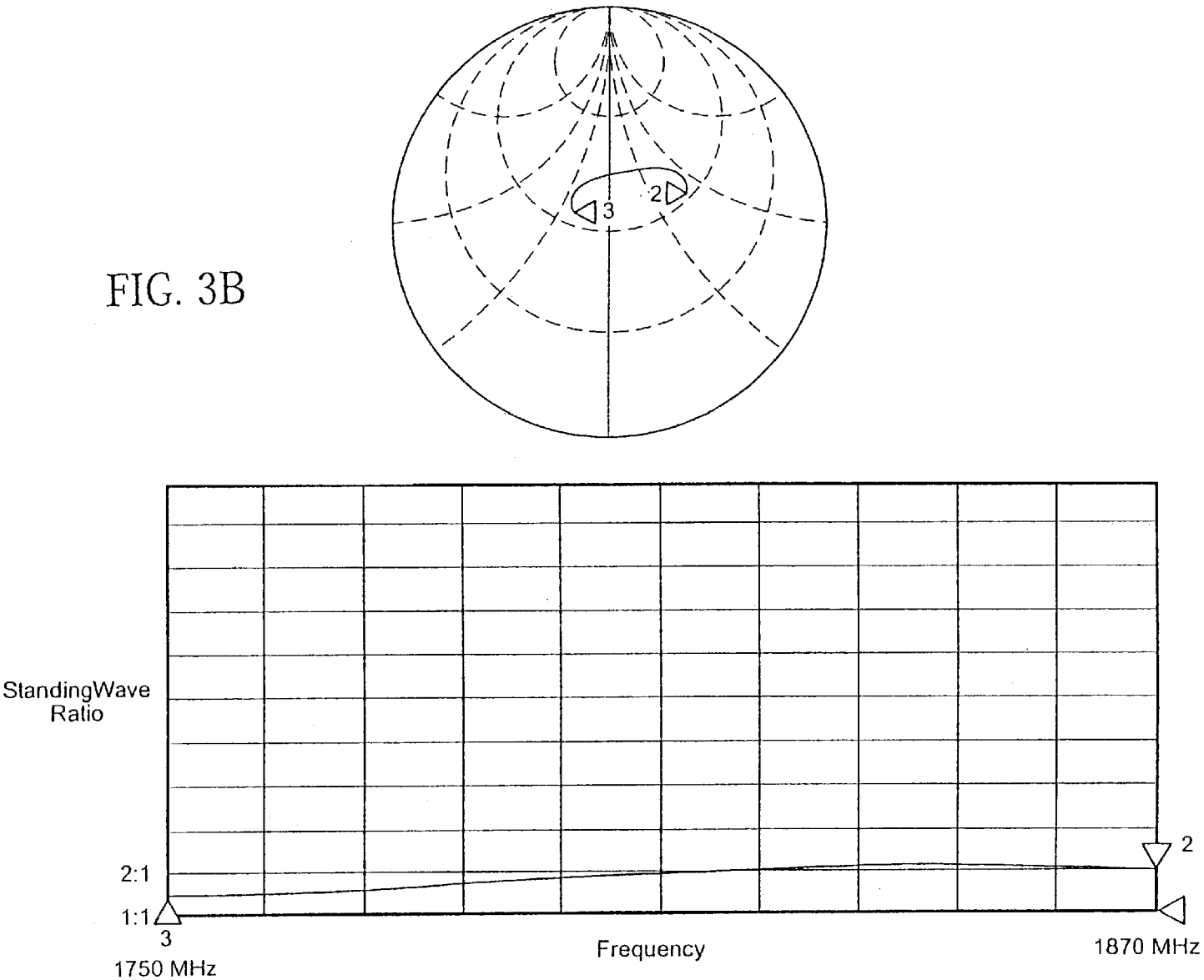
FIG. 3B includes an exemplary VSWR (voltage standing wave ratio) plot over the frequency range 1.75–1.87 GHz for the same practical antenna system and an exemplary Smith chart response indicating a classic resonant circuit response (the response is nearly equal above and below the horizontal pure resistance line), which demonstrates that the director element does not undesirably skew the antenna system's characteristic impedance. In the Smith chart, point 3 is about 58.5+j17.5 ohms and point 2 is 54.5–j36.5 ohms. In the SWR chart, point 3 is an SWR of 1.43:1 at 1750 MHz and point 2 is an SWR of 2.0:1 at 1870 MHz.

Measured test data in the 1.75–1.87 GHz band for an antenna system in a HHWCD having dimensions for elements 1, 2 and 3 as shown in FIGS. 2A–F and for spacing 12 at 0.05 wavelength, is shown in FIGS. 3A–B.

A polar radiation pattern with rotation about the x-axis of a practical embodiment of the antenna system of FIG. 1A is shown in FIG. 3A. The responses shown are for a series of frequencies in the frequency range 1.75 GHz to 1.87 GHz. Zero degrees on this plot is 180 degrees from direction 10, with a relative amplitude of −12 dB nominal with respect to direction 10. This clearly shows reduced energy radiated toward the user. This directivity results from the parasitic director element 2 shown in FIG. 1A and FIG. 1B.

Referring to FIG. 3B, the input VSWR measured at the feed point 6 of element 1 with respect to a nearby point on element 3, referenced to 50 ohms, is plotted over the 1.75–1.87 GHz frequency band for the practical embodiment whose polar plot is shown in FIG. 3A, as just discussed. The maximum VSWR value is 2:1 nominal, which is well within a useful range. An excellent match to 50 ohms is demonstrated over 1.75–1.87 GHz. This VSWR is achieved by design, including the following:

a) the circuit trace pattern on the quarter-wave resonator 1, including its matching section between points 5 and 6 (see FIG. 2A);

b) the relative position of element 1 with respect to element 3;

c) the spacing 12 between the planes of elements 2 and 3 (see FIG. 1A and FIG. 1B);

d) the size of the parasitic director element 2.

The VSWR response also indicates that the antenna system has a usable bandwidth of about 5 to 10%.

Figure 4:
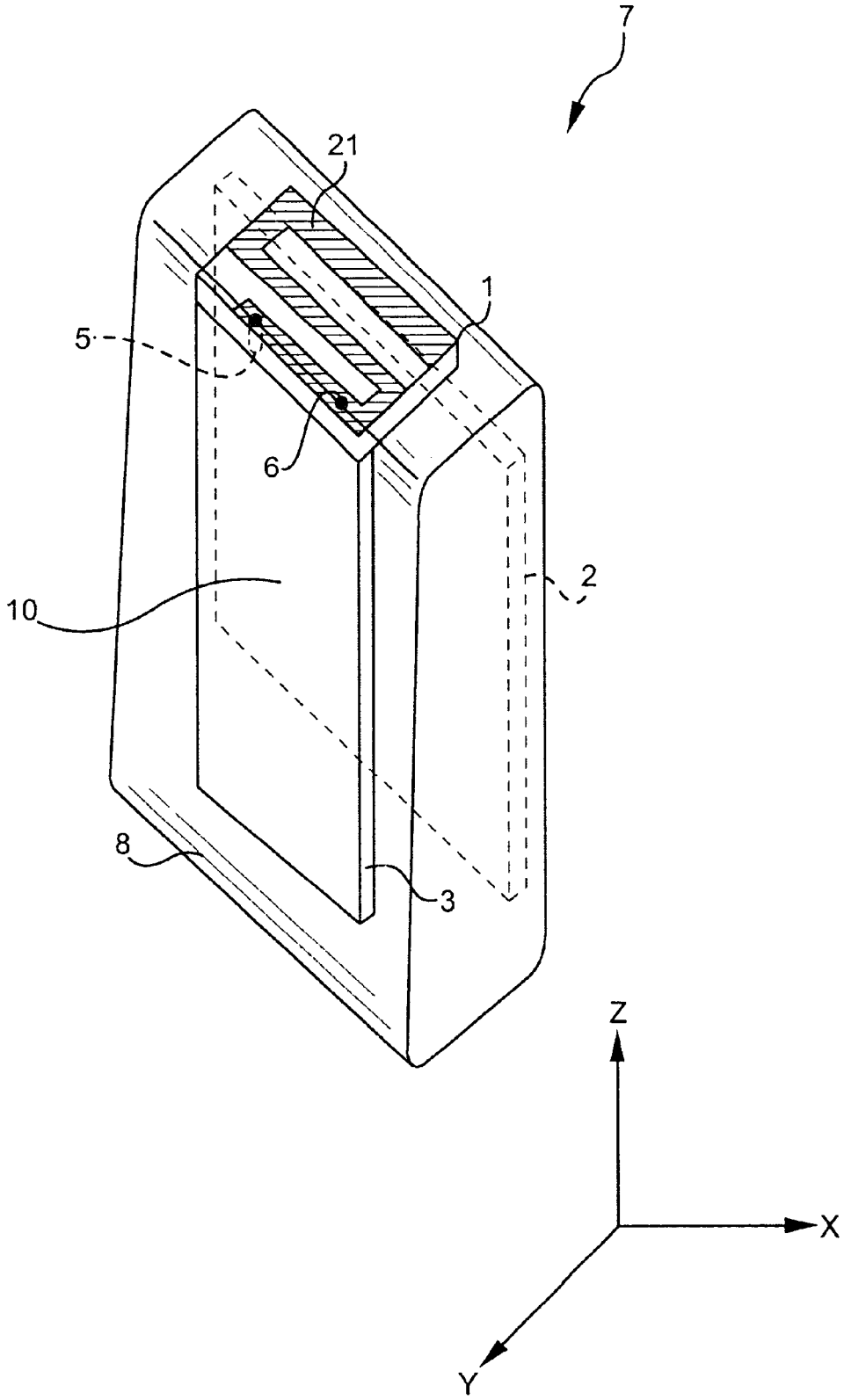
FIG. 4 is an idealized perspective view of alternative embodiment of the antenna system according to the present invention, located within a HHWCD case. The figure is not to scale. In this alternative embodiment, the resonator element is perpendicular to the planar radiating element.

An alternative embodiment 7 of the antenna system is shown in FIG. 4. In this alternative, the planar resonator 1 is installed perpendicular to the planar conductive element 3. This arrangement requires less volume in the HHWCD. An electrical connection at point 5 is provided between elements 1 and 3, and a 50 ohm feed point is provided between point 6 and an nearby corresponding point in element 3, in the same manner as in the embodiment of FIG. 1A. Thus, resonator element 1 is shunt fed as in the manner of the FIG. 1A embodiment. For illustration purposes, a simplified conductor trace 21 on the PCB of the resonator element 1 are shown. In practice, such a simplified conductor trace may be used for devices having this or other relative locations of element 1 with respect to element 3, including the embodiment of FIG. 1A. The particular manner in which the resonator element 1 is held with respect to the planar radiating element is not critical (right-angle pins, for example, may be used). The resonator element of the embodiment of FIG. 4 may also be a dual band resonator, as described above.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

We claim:

1. An antenna for a wireless communication device for receiving and transmitting a communication signal said antenna comprising:

an asymmetric dipole comprising a radiator portion defined by conductive traces on a printed wiring board having associated electronic componentry, and a resonator portion having a conductive trace defined thereupon, said conductive trace being electrically coupled to the radiator portion at a first location and being electrically coupled to a feedline line of the communication device at a second location away from the first location; and a dual band parasitic element disposed away from a user during operation of the wireless communication device relative to the asymmetric dipole, said dual band parasitic element comprising a conductive trace upon a dielectric substrate, said conductive trace include a pair of opposed ends, each of the pair of ends including an inductor portion and a capacity hat portion.

2. The antenna of claim 1 wherein the conductive traces on the printed wiring board define the ground plane of the associated electronic componentry.

3. The antenna of claim 1 wherein the resonator portion is defined upon a generally planar dielectric substrate separate from the radiator portion.

4. The antenna of claim 1 wherein the resonator portion is defined as a serpentine conductive trace having a matching section between the first location and the second location.

5. An antenna for a wireless communication device comprising:

an asymmetric dipole comprising a radiator portion defined by conductive traces on a printed wiring board within a housing of the wireless communication device, and a resonator portion having a conductive trace defined thereupon, said conductive trace being electrically coupled to the radiator portion at a first location and being electrically coupled to a feedline line of the communication device at a second location away from the first location; and a dual band parasitic element within the housing and disposed away from a user during operation of the wireless communication device relative to the asymmetric dipole, said dual band parasitic element comprising a conductive trace upon a dielectric substrate, said conductive trace include a pair of opposed ends, each of the pair of ends including an inductor portion and a capacity hat portion.

6. The antenna of claim 5 wherein the conductive traces on the printed wiring board define the ground plane of an electronic componentry.

7. The antenna of claim 5 wherein the resonator portion is defined upon a generally planar dielectric substrate separate from the radiator portion.

8. The antenna of claim 5 wherein the resonator portion is defined as a serpentine conductive trace having a matching section between the first location and the second location.

9. The antenna of claim 5 wherein the inductor portion of the dual band parasitic element is defined as a serpentine conductive trace.

10. The antenna of claim 5 wherein the capacity hat portion of the dual band parasitic element is defined as a generally rectangular conductive trace.

11. An antenna for a wireless communication device comprising:

an asymmetric dipole comprising a radiator portion defined by conductive traces on a printed wiring board within a housing of the wireless communication device, and a resonator portion having a conductive trace defined thereupon, said conductive trace being electrically coupled to the radiator portion at a first location and being electrically coupled to a feedline line of the communication device at a second location away from the first location; and a dual band parasitic element within the housing and disposed away from a user during operation of the wireless communication device relative to the asymmetric dipole, said dual band parasitic element comprising conductive traces upon a dielectric substrate, said conductive traces including a central trace and a pair of end traces, and each of the pair of end traces including an inductor portion and a capacity hat portion.

12. The antenna of claim 11 wherein the conductive traces on the printed wiring board define the ground plane of an electronic componentry.

13. The antenna of claim 11 wherein the resonator portion is defined as a serpentine conductive trace having a matching section between the first location and the second location.

14. The antenna of claim 11 wherein the inductor portion of the dual band parasitic element is defined as a serpentine conductive trace.

15. The antenna of claim 11 wherein the capacity hat portion of the dual band parasitic element is defined as a generally rectangular conductive trace.

16. The antenna of claim 11 wherein the dual band parasitic element is defined upon a generally planar dielectric substrate.

17. The antenna of claim 11 wherein a plane including the dielectric substrate of the dual band parasitic element is generally parallel with another plane including the printed wiring board.

* * * * *